US011373849B2

(12) United States Patent
Shion et al.

(10) Patent No.: US 11,373,849 B2
(45) Date of Patent: Jun. 28, 2022

(54) MASS SPECTROMETER HAVING FRAGMENTATION REGION

(71) Applicant: Micromass UK Limited, Wilmslow (GB)

(72) Inventors: Henry Y. Shion, Hopkinton, MA (US); Robert Lewis, Manchester (GB); David Jonathan Pugh, Alderley Edge (GB); Ying-Qing Yu, Uxbridge, MA (US)

(73) Assignee: Micromass UK Limited, Wilmslow (GB)

( * ) Notice: Subject to any disclaimer, the term of this patent is extended or adjusted under 35 U.S.C. 154(b) by 576 days.

(21) Appl. No.: 16/428,054

(22) Filed: May 31, 2019

(65) Prior Publication Data

US 2019/0371583 A1 Dec. 5, 2019

Related U.S. Application Data

(60) Provisional application No. 62/678,413, filed on May 31, 2018.

(51) Int. Cl.
*H01J 49/00* (2006.01)
*H01J 49/24* (2006.01)

(52) U.S. Cl.
CPC ..... *H01J 49/005* (2013.01); *H01J 49/0031* (2013.01); *H01J 49/24* (2013.01)

(58) Field of Classification Search
CPC ..... H01J 49/24; H01J 49/005; H01J 49/0031; H01J 49/062; H01J 49/063; H01J 49/405; H01J 49/0495; H01J 49/4215; F04D 29/122; F04D 29/701
See application file for complete search history.

(56) References Cited

U.S. PATENT DOCUMENTS 2,901,622 A 8/1959 Baldwin
4,314,156 A 2/1982 Kuppermann et al.
4,458,149 A 7/1984 Muga
5,025,391 A 6/1991 Filby et al.
(Continued)

FOREIGN PATENT DOCUMENTS

CN 103684817 A 3/2014
CN 205705229 U 11/2016
(Continued)

OTHER PUBLICATIONS

Examination Report under Section 18(3) for Application No. GB2020743.7, dated Jan. 28, 2022, 6 pages.
(Continued)

*Primary Examiner* — David E Smith
*Assistant Examiner* — Hsien C Tsai
(74) *Attorney, Agent, or Firm* — Goodwin Procter LLP

(57) ABSTRACT

A mass spectrometer is disclosed comprising: a first vacuum chamber having an inlet aperture; a second vacuum chamber; a differential pumping aperture separating the vacuum chambers; and an ion guide arranged in the first vacuum chamber for guiding ions from the inlet aperture to and through the differential pumping aperture. The ion guide has a construction for handling high gas loads such that the spectrometer is able to maintain the gas pressure in the first vacuum chamber such that when ions are accelerated therethrough the ions collide with gas and fragment.

20 Claims, 7 Drawing Sheets

(56) References Cited

U.S. PATENT DOCUMENTS 5,593,123 A 1/1997 Crawford
5,756,994 A 5/1998 Bajic
5,776,216 A 7/1998 Yang
5,825,025 A 10/1998 Kerley
5,933,335 A 8/1999 Hitchcock et al.
6,013,913 A 1/2000 Hanson
6,049,077 A 4/2000 Franzen
6,106,223 A 8/2000 Leyshon
6,248,998 B1 6/2001 Okumoto et al.
6,316,768 B1 11/2001 Rockwood et al.
6,502,999 B1 1/2003 Cohen et al.
6,527,458 B2 3/2003 Kim
6,566,653 B1 5/2003 Gerber et al.
6,643,075 B2 11/2003 Wang et al.
6,663,294 B2 12/2003 Crane, Jr. et al.
6,712,528 B2 3/2004 Galeotti et al.
6,772,649 B2 8/2004 Zimmermann et al.
6,792,171 B2 9/2004 Hargis et al.
6,824,314 B2 11/2004 Bendelli et al.
6,835,928 B2 12/2004 Bateman
6,847,036 B1 1/2005 Darling et al.
6,862,378 B2 3/2005 Kamacewicz et al.
6,869,231 B2 3/2005 Chiu et al.
6,877,912 B2 4/2005 Cho et al.
6,888,129 B2 5/2005 Bowdler et al.
6,888,860 B2 5/2005 Shaw
6,903,332 B2 6/2005 Weiss et al.
6,956,205 B2 10/2005 Park
6,977,369 B2 12/2005 Yamaguchi et al.
7,019,285 B2 3/2006 Dresch et al.
7,129,163 B2 10/2006 Sherrer et al.
7,149,389 B2 12/2006 Yoon et al.
7,211,794 B2 5/2007 Malek et al.
7,247,847 B2 7/2007 Webb et al.
7,309,861 B2 12/2007 Brown et al.
7,322,754 B2 1/2008 Wolf et al.
7,359,642 B2 4/2008 Richardson et al.
7,372,021 B2 5/2008 Cotter et al.
7,375,318 B2 5/2008 Kikuma et al.
7,550,722 B2 6/2009 Scheidemann et al.
7,597,488 B2 10/2009 Fisher
7,622,711 B2 11/2009 Wildgoose et al.
7,645,986 B2 1/2010 Kikuma et al.
7,786,435 B2 8/2010 Whitehouse et al.
7,812,309 B2 10/2010 Guevremont et al.
7,820,980 B2 10/2010 Balogh
7,825,374 B2 11/2010 Cotter et al.
7,829,841 B2 11/2010 Bateman et al.
7,888,630 B2 2/2011 Wong
7,893,401 B2 2/2011 Ding
7,919,747 B2 4/2011 Green et al.
7,960,694 B2 6/2011 Hoyes
8,138,119 B2 3/2012 Fischer et al.
8,153,960 B2 4/2012 Giles et al.
8,183,524 B2 5/2012 Kenny et al.
8,227,749 B2 7/2012 Alonso
8,253,096 B2 8/2012 Numata
8,357,892 B2 1/2013 Suyama et al.
8,426,802 B2 4/2013 Giles et al.
8,507,849 B2 8/2013 Brown
8,513,597 B2 8/2013 Panayi
8,552,367 B2 10/2013 Danel et al.
8,637,810 B2 1/2014 Mukaibatake et al.
8,653,452 B2 2/2014 Albeanu et al.
8,704,172 B2 4/2014 Baykut
8,716,660 B2 5/2014 Green et al.
8,742,339 B2 6/2014 Hoyes
8,822,915 B2 9/2014 Mukaibatake et al.
8,927,928 B2 1/2015 Decker et al.
8,975,578 B2 3/2015 Green et al.
9,012,840 B2 4/2015 Bateman et al.
9,048,075 B1 6/2015 Kodera
9,058,968 B2 6/2015 Danel et al.
9,105,456 B2 8/2015 Jiang et al.
9,184,039 B2 11/2015 Pringle et al.
9,196,469 B2 11/2015 Makarov
9,281,171 B2 3/2016 Bateman et al.
9,287,100 B2 3/2016 Szalay et al.
9,318,309 B2 4/2016 Brown et al.
9,355,832 B2 5/2016 Chiappetta et al.
9,466,472 B2 10/2016 Bateman et al.
9,536,721 B2 1/2017 Berdnikov et al.
9,536,727 B2 1/2017 Satoh
9,552,975 B2 1/2017 Brown et al.
9,564,307 B2 2/2017 Makarov
9,601,323 B2 3/2017 Nishiguchi et al.
9,607,820 B2 3/2017 Bateman et al.
9,754,773 B1 9/2017 Gonzalez et al.
9,768,008 B2 9/2017 Verenchikov
9,812,308 B2 11/2017 Berdnikov et al.
9,859,106 B2 1/2018 Chiappetta et al.
9,865,444 B2 1/2018 Okumura
9,870,904 B2 1/2018 Covey et al.
9,870,906 B1 1/2018 Quarmby et al.
9,880,129 B2 1/2018 Bateman
9,939,407 B2 4/2018 Giles et al.
9,978,572 B2 5/2018 Giles et al.
9,984,861 B2 5/2018 Giles et al.
9,984,863 B2 5/2018 Verenchikov
10,014,167 B2 7/2018 Zhang et al.
10,020,181 B2 7/2018 Okumura
2001/0017351 A1 8/2001 Terakura
2001/0030284 A1 10/2001 Dresch et al.
2002/0100870 A1 8/2002 Whitehouse et al.
2002/0131724 A1 9/2002 Bailey et al.
2003/0003595 A1 1/2003 Amirav
2003/0027354 A1 2/2003 Geli
2003/0193019 A1 10/2003 Nagano et al.
2004/0089803 A1 5/2004 Foley
2005/0213353 A1 9/2005 Lys
2006/0076483 A1 4/2006 Scheidemann et al.
2006/0219891 A1 10/2006 Balogh
2006/0237663 A1 10/2006 Balogh
2007/0164209 A1 7/2007 Balogh
2008/0087841 A1 4/2008 Verbeck et al.
2008/0149825 A1 6/2008 Kozlovski et al.
2009/0101814 A1 4/2009 Amirav
2009/0179148 A1 7/2009 Yasuda et al.
2010/0243887 A1 9/2010 Suyama et al.
2011/0127416 A1 6/2011 Campuzano et al.
2011/0174969 A1 7/2011 Seyfarth
2011/0220786 A1 9/2011 Satoh
2012/0068064 A1 3/2012 Numata
2012/0085901 A1 4/2012 Gilbert et al.
2012/0205534 A1 8/2012 Hunter et al.
2013/0183355 A1 7/2013 Jain et al.
2014/0183355 A1 7/2014 Bartfay-Szabo et al.
2014/0346345 A1 11/2014 Makarov
2014/0367563 A1 12/2014 Zhong et al.
2015/0076338 A1 3/2015 Young et al.
2015/0123354 A1 5/2015 Laser et al.
2015/0263642 A1 9/2015 Lin et al.
2015/0323500 A1 11/2015 Davis et al.
2016/0148796 A1 5/2016 Makarov
2016/0155620 A1 6/2016 Makarov
2016/0172179 A1 6/2016 Deerberg et al.
2016/0203967 A1 7/2016 Atkinson et al.
2016/0247668 A1 8/2016 Szalay et al.
2016/0284526 A1 9/2016 Kenny et al.
2016/0293395 A1 10/2016 O'Brien et al.
2016/0322960 A1 11/2016 Taylor et al.
2016/0336158 A1 11/2016 Kovarik
2017/0074283 A1 3/2017 Manabe
2017/0082585 A1 3/2017 DeWitte et al.
2017/0092477 A1 3/2017 Giles et al.
2017/0115383 A1 4/2017 Iwama et al.
2017/0168031 A1 6/2017 Verenchikov
2017/0169633 A1 6/2017 Leung et al.
2017/0190566 A1 7/2017 Cramm et al.
2017/0236699 A1 8/2017 Ueda et al.
2017/0287692 A1 10/2017 Bateman et al.
2017/0309465 A1 10/2017 Jarrell
2017/0372881 A1 12/2017 Hoyes
2018/0038838 A1* 2/2018 Karancsi ..... C12Q 1/18

(56) References Cited

U.S. PATENT DOCUMENTS

| | | | |
|---|---|---|---|
| 2018/0053640 A1 | 2/2018 | Kurulugama et al. | |
| 2018/0102241 A1 | 4/2018 | Gordon et al. | |
| 2021/0151307 A1* | 5/2021 | Guna | H01J 49/4215 |

FOREIGN PATENT DOCUMENTS

| | | | |
|---|---|---|---|
| CN | 206955673 | U | 2/2018 |
| DE | 2817665 | A1 | 10/1979 |
| DE | 102018105603 | A1 | 5/2018 |
| EP | 0233784 | A2 | 8/1987 |
| EP | 0317060 | A2 | 5/1989 |
| EP | 0792091 | A1 | 8/1997 |
| EP | 0919726 | A1 | 6/1999 |
| EP | 1137044 | A2 | 9/2001 |
| EP | 1393059 | A1 | 3/2004 |
| EP | 1530229 | A1 | 5/2005 |
| EP | 1597749 | A2 | 11/2005 |
| EP | 1820203 | A2 | 8/2007 |
| EP | 1830386 | A2 | 9/2007 |
| EP | 1933365 | A1 | 6/2008 |
| EP | 1933366 | A1 | 6/2008 |
| EP | 1964153 | A2 | 9/2008 |
| EP | 1166328 | B1 | 11/2008 |
| EP | 1397822 | B1 | 3/2010 |
| EP | 1884980 | B1 | 6/2011 |
| EP | 1817789 | B1 | 11/2011 |
| EP | 2431997 | A2 | 3/2012 |
| EP | 2450941 | A1 | 5/2012 |
| EP | 1825496 | B1 | 6/2012 |
| EP | 2533042 | A1 | 12/2012 |
| EP | 2567397 | A2 | 3/2013 |
| EP | 2587521 | A1 | 5/2013 |
| EP | 2092549 | B1 | 8/2013 |
| EP | 2660850 | A1 | 11/2013 |
| EP | 2633299 | B1 | 9/2014 |
| EP | 2774172 | A2 | 9/2014 |
| EP | 2797105 | A1 | 10/2014 |
| EP | 2798657 | A2 | 11/2014 |
| EP | 2806553 | A2 | 11/2014 |
| EP | 1810314 | B1 | 4/2015 |
| EP | 2866247 | A1 | 4/2015 |
| EP | 1738398 | B1 | 6/2015 |
| EP | 2038913 | B1 | 7/2015 |
| EP | 2913914 | A1 | 9/2015 |
| EP | 3005403 | A2 | 4/2016 |
| EP | 3073509 | A1 | 9/2016 |
| EP | 3084422 | A1 | 10/2016 |
| EP | 3211781 | A1 | 8/2017 |
| EP | 2033208 | B1 | 11/2017 |
| EP | 3244439 | A1 | 11/2017 |
| EP | 1789989 | B1 | 12/2017 |
| EP | 2485243 | B1 | 3/2018 |
| EP | 3404695 | A1 | 11/2018 |
| EP | 1880406 | B1 | 7/2019 |
| GB | 1593998 | A | 7/1981 |
| GB | 2219432 | A | 12/1989 |
| GB | 2329066 | A | 3/1999 |
| GB | 2435712 | A | 9/2007 |
| GB | 2440970 | A | 2/2008 |
| GB | 2455171 | A | 6/2009 |
| GB | 2473839 | A | 3/2011 |
| GB | 2486584 | A | 6/2012 |
| GB | 2489975 | A | 10/2012 |
| GB | 2493072 | A | 1/2013 |
| GB | 2515284 | A | 12/2014 |
| GB | 2519853 | A | 5/2015 |
| GB | 2533168 | A | 6/2016 |
| GB | 2541808 | A | 3/2017 |
| GB | 2552965 | A | 2/2018 |
| JP | S60180322 | A | 9/1985 |
| JP | H01121747 | A | 5/1989 |
| JP | H03233850 | A | 10/1991 |
| JP | H10233187 | A | 9/1998 |
| JP | H1125903 | A | 1/1999 |
| JP | H11230087 | A | 8/1999 |
| JP | 2001050944 | A | 2/2001 |
| JP | 2004226313 | A | 8/2004 |
| JP | 2005285543 | A | 10/2005 |
| JP | 2012043672 | A | 3/2012 |
| JP | 2014022075 | A | 2/2014 |
| JP | 2015121406 | A | 7/2015 |
| WO | 9921212 | A1 | 4/1999 |
| WO | 0185312 | A1 | 11/2001 |
| WO | 02101382 | A1 | 12/2002 |
| WO | 2004077488 | A2 | 9/2004 |
| WO | 2006061625 | A1 | 6/2006 |
| WO | 2006129083 | A2 | 12/2006 |
| WO | 2007071991 | A2 | 6/2007 |
| WO | 2007131146 | A2 | 11/2007 |
| WO | 2008071923 | A2 | 6/2008 |
| WO | 2009037483 | A2 | 3/2009 |
| WO | 2010064321 | A1 | 6/2010 |
| WO | 2011138669 | A2 | 11/2011 |
| WO | 2012058632 | A1 | 5/2012 |
| WO | 2013039772 | A1 | 3/2013 |
| WO | 2013064842 | A2 | 5/2013 |
| WO | 2013066881 | A2 | 5/2013 |
| WO | 2013098642 | A2 | 7/2013 |
| WO | 2014074822 | A1 | 5/2014 |
| WO | 2014191750 | A1 | 12/2014 |
| WO | 2014194023 | A2 | 12/2014 |
| WO | 2014194172 | A2 | 12/2014 |
| WO | 2015009478 | A1 | 1/2015 |
| WO | 2015040386 | A1 | 3/2015 |
| WO | 2015092501 | A1 | 6/2015 |
| WO | 2017122276 | A1 | 7/2017 |
| WO | 2018138814 | A1 | 8/2018 |

OTHER PUBLICATIONS

Examination Report under Section 18(3) for Application No. GB1907719.7, dated Jul. 28, 2021, 9 pages.

Parkes, S. SpaceWire User Guide, STAR-Dundee [online] 2012 [retrieved on Aug. 13, 2021], Retrieved from Internet URL: https://www.star-dundee.com/wp-content/star_uploads/general/SpaceWire-Users-Guide.pdf, 117 pages.

SCIEX, "3200 Series of Instruments System User Guide" [online], published Apr. 2018, available from: https://sciex.com/content/dam/SCIEX/pdf/customer-docs/user-guide/3200-system-user-guide-en.pdf, 241 pages.

Combined Search and Examination Report under Sections 17 and 18(3) for Application No. GB1808932.6, dated Nov. 21, 2018, 4 pages.

Combined Search and Examination Report under Sections 17 and 18(3) for Application No. GB1808890.6, dated Nov. 28, 2018, 7 pages.

Combined Search and Examination Report under Sections 17 and 18(3) for Application No. GB1808912.8, dated Nov. 30, 2018, 10 pages.

Combined Search and Examination Report under Sections 17 and 18(3) for Application No. GB1808942.5, dated Dec. 3, 2018, 7 pages.

Chernushevich, I. V., et al., "An introduction to quadrupole-time-of-flight mass spectrometry", Journal of Mass Spectrometry, 36(8):849-65 (2001) Abstract only.

Chernushevich, I.V., et al., "Charge state separation for protein applications using a quadrupole time-of-flight mass spectrometer", Rapid Communications in Mass Spectrometry 17(13):1416-1424 (2003). Abstract only.

Makarov, A. et al., "Performance evaluation of a hybrid linear ion trap/orbitrap mass spectrometer," Analytical Chemistry, 78(7):2113-20 (2006). Abstract only.

Combined Search and Examination Report under Sections 117 and 18(3) for Application No. GB1808948.2 dated Nov. 21, 2018, 7 pages.

Combined Search and Examination Report under Sections 17 and 18(3) for Application No. GB1808893.0 dated Nov. 27, 2018, 8 pages.

(56) References Cited

OTHER PUBLICATIONS

Combined Search and Examination Report under Sections 17 and 18(3) for Application No. GB1808936.7 dated Nov. 20, 2018, 10 pages.
Combined Search and Examination Report under Sections 17 and 18(3) for Application No. GB1808892.2, dated Dec. 3, 2018, 6 pages.
Combined Search and Examination Report under Sections 17 and 18(3) for Applicaton No. GB1808894.8 dated Dec. 3, 2018, 7 pages.
Combined Search and Examination Report under Sections 17 and 18(3) for Application No. GB1808949.0 dated Oct. 31, 2018, 8 pages.
Combined Search and Examination Report under Sections 17 and 18(3) for Application No. GB1907722.1 dated Jun. 28, 2019, 8 pages.
Combined Search and Examination Report under Sections 17 and 18(3) for Application No. GB1808889.8 dated Nov. 30, 2018, 7 pages.
International Search Report and Written Opinion for International application No. PCT/GB2019/051504, dated Jul. 23, 2019, 11 pages.
Combined Search and Examination Report under Sections 17 and 18(3) for Application No. GB1818003.4, dated May 2, 2019, 6 pages.
Invitation to pay additional fees and, where applicable, protest fee for PCT/GB2019/051508, dated Aug. 28, 2019.
Author unknown, "Operating Manual and Programming Reference, Models RGA100, RGA200, and RGA300 Residual Gas Analyzer," Stanford Research Systems Revision 1.8 (May 2009).
Jungmann, J. H., et al., "An in-vacuum, pixelated detection system for mass spectrometric analysis and imaging of macromolecules," International Journal of Mass Spectrometry, 341-342:34-44 (2013).
Invitation to pay additional fees and, where applicable, protest fee for International application No. PCT/GB2019/051507, dated Aug. 20, 2019, 16 pages.
Yang, C., and Hanley, L., "ChiMS: Open-source instrument control software platform on LabVIEW for imaging/depth profiling mass spectrometers," Review of Scientific Instruments, 86:065106-1 through 065016-7 (2015).
Invitation to pay additional fees and, where applicable, protest fee for International application No. PCT/GB2019/051506, dated Jul. 22, 2019, 13 pages.
Invitation to pay addition al fees and, where applicable, protest fee for PCT/GB2019/051503, dated Jul. 25, 2019, 17 pages.
International Search Report and Written Opinion for International application No. PCT/GB2019/051500, dated Aug. 5, 2019, 9 pages.
Kozlov, B., et al., "Time-of-flight mass spectrometer for investigations of laser ablation," ASMS Conference paper, Dallas, TX (May 1999). [Retrieved from the Internet URL: https//www.researchgate.net/publication/330202298_Time-of-flight_mass_spectrometer_for_investigations_of_laser_ablation]. Abstract.
Shion, H., et al., "Towards Overcoming the Challenges of Implementing Accurate Mass MS for Routine Biotherapeutic Analysis" 2018 ASMS Prototype oa-TOF Abstract HYS Final.
Shion, S., et al., "Towards Overcoming the Challenges of Implementing Accurate Mass MS for Routine Biotherapeutic Analysis" 2018 ASMS Prototype oa-TOF WP699 HYS Final Poster.
Shion, H., et al., "A Fit-for-purpose Accurate Mass MS for Routine Biotherapeutic Analysis", 2018 CASSS Mass Spec HYS Final Poster.
Shion, H., et al., "A Fit-for-purpose Accurate Mass MS for Routine Biotherapeutic Analysis", 2018 CASSS Mass Spec BioTof HYS Final, Abstract.
Shion, H., et al., "Progress Towards Implementing Simple Time-of-flight Accurate Mass MS for Routine Biotherapeutic Analysis", XXII (IMSC) International Mass Spectrometry Conference Florence, Italy (2018) Abstract.
Shion, H., et al., "Progress Towards Implementing Simple Time-of-flight Accurate Mass MS for Routine Biotherapeutic Analysis", XXII International Mass Spectrometry Conference Florence, Italy (2018) poster.
Shion, H., et al., "Meeting the Challenges of Implementing Accurate-Mass Mass Spectrometry for Biotherapeutic Development in Regulated/non-Regulated Environments", 2019 ASMS BioAccord Oral Session PowerPoint.
Shion, H., et al., "Meeting the Challenges of Implementing Accurate-Mass Mass Spectrometry for Biotherapeutic Development in Regulated/non-Regulated Environments", 2019 ASMS BioAccord Abstract.
Shion, H., et al., "Meeting the Challenges of Implementing Accurate-Mass Mass Spectrometry for Biotherapeutic Development in Regulated/non-Regulated Environments" 2019 ATEurope BioAccord, Abstract.
Shion, H., et al., "Meeting the Challenges of Implementing Accurate-Mass Mass Spectrometry for Biotherapeutic Development in Regulated/non-Regulated Environments" 2019 ATEurope BioAccord, Poster.
Shion, H., et al., "Meeting the Challenges of Implementing Accurate-Mass Mass Spectrometry for biotherapeutic Development in Regulated/non-Regulated Environments", 2019 BioPharma Analytical Summit BioAccord, abstract.
Shion, H., et al., "Meeting the Challenges of Implementing Accurate-Mass Mass Spectrometry for Biotherapeutic Development in Regulated/non-Regulated Environments", 2019 Bio Pharma Summit BioAccord, Poster.
Shion, H., "Enabling Routine and Reproducible Biotherapeutic Analysis when Data Integrity Matters", 2019 15th Annual PEGs Boston Waters BioAccord, PowerPoint 29 pages.
Shion, H., "Enabling Routine and Reproducible Biotherapeutic Analysis when Data Integrity Matters", 2019 15th Annual PEGs Boston Waters BioAccord, Abstract.
Shion, H., et al., "Meeting the Challenges of Implementing Accurate-Mass Mass Spectrometry for Biotherapeutic Development in Regulated/non-Regulated Environments", 2019 Pitt Con Bio Accord, Poster.
Shion, H., et al., "Meeting the Challenges of Implementing Accurate-Mass Mass Spectrometry for Biotherapeutic Development in Regulated/non-Regulated Environments", 2019 Pitt Con Bio Accord, Abstract.
Combined S and E Report from IPO for GB Application No. 1907739.5, dated Nov. 27, 2019, 8 pages.
International Search Report and Written Opinion for International application No. PCT/GB2019/051510, dated Aug. 29, 2019, 13 pages.
Combined S and E Report from IPO for GB Application No. 1907735.3, dated Nov. 25, 2019, 7 pages.
Combined S and E Report under Sections 17 and 18(3) for Application No. GB1907734.6, dated Oct. 31, 2019, 7 pages.
International Search Report and Written Opinion for International Application No. PCT/GB2019/051498, dated Nov. 6, 2019, 21 pages.
Combined Search and Examination Report under Sections 17 and 18(3) for Application No. GB1907719.7, dated Nov. 15, 2019, 11 pages.
Author unknown, "Waters Xevo G2-S QTof Operators Overview and Maintenance Guide", Feb. 11, 2013 (Feb. 11, 2013), XP55606374, Retrieved from the Internet: URL:https://www.waters.eom/webassets/cms/support/docs/xevo_g2-s_qtof_715003596rb.pdf [retrieved on Jul. 17, 2019].
International Search Report and Written Opinion for International application No. PCT/GB2019/051501, dated Sep. 25, 2019, 17 pages.
Combined Search and Examination Report under Sections 17 and 18(3), for Application No. GB1907724 7, dated Sep. 25, 2019, 7 pages.
Invitation to Pay Additional Fees and, Where Applicable, Protest Fee for International application No. PCT/GB2019/051494, dated Sep. 19, 2019.
Combined Search and Examination Report under Sections 17 and 18(3), dated Sep. 27, 2019, for Application No. GB1907736.1, 6 pages.
Invitation to Pay Additional Fees and, Where Applicable, Protest Fees, for International application No. PCT/GB2019/051499, dated Sep. 4, 2019.

(56) References Cited

OTHER PUBLICATIONS

Invitation to Pay Additional Fees and, Where Applicable, Protest Fee, for International Application No. PCT/GB2019/051496, dated Aug. 29, 2019.
Anonymous, "Time-of-flight mass spectrometry", Wikipedia, Apr. 28, 2018 (Apr. 28, 2018), XP055614063, Retrieved from the Internet:URL:https://en.wikipedia.org/w/index.php title=Time-of-flight_mass_spectrometry oldid=838663844 [retrieved on Aug. 20, 2019].
Invitation to Pay Additional Fees and, Where Applicable, Protest Fees for International application No. PCT/GB2019/051497, dated Sep. 2, 2019.
Combined Search and Examination Report under Sections 17 and 18(3) for Application No. GB1907745.2, dated Aug. 13, 2019, 7 pages.
Invitation to Pay Additional Fees and, Where Applicable, Protest Fee, for International application No. PCT/GB2019/051501, dated Jul. 29, 2019, 14 pages.
International Search Report and Written Opinion for International application No. PCT/GB2019/051497, dated Nov. 5, 2019, 19 pages.
International Search Report and Written Opinion for International application No. PCT/GB2019/051503, dated Sep. 25, 2019, 17 pages.
International Search Report and Written Opinion for International application No. PCT/GB2019/051496, dated Oct. 23, 2019, 29 pages.
International Search Report and Written Opinion for International application No. PCT/GB2019/051506, dated Sep. 25, 2019, 14 pages.
International Search Report and Written Opinion for International application No. PCT/GB2019/051494, dated Nov. 18, 2019, 20 pages.
International Search Report and Written Opinion for International application No. PCT/GB2019/051507, dated Oct. 15, 2019, 17 pages.
International Search Report and Written Opinion for International application No. PCT/GB2019/051508, dated Oct. 23, 2019, 16 pages.
International Search Report and Written Opinion for International application No. PCT/GB2019/051499, dated Nov. 5, 2019, 19 pages.
Examination Report under Section 18(3) for Application No. GB1907739.5, dated Nov. 3, 2020, 5 pages.
Combined Search and Examination Report under Sections 17 and 18(3), for Application No. GB2100898.2, dated Jun. 21, 2021, 7 pages.
Combined Search and Examination Report under Sections 17 and 18(3), for Application No. GB2001530.1, dated Aug. 5, 2020, 7 pages.
Thermo Fisher Scientific, Inc, Feb. 2015, Orbitrap Fusion Hardware Manual [online]. Retrieved from Internet URL: http://www.unitylabservices.eu/content/dam/tfs/ATG/CMD/cmddocuments/oper/oper/ms/lc-ms/sys/Man-80000-97016-Orbitrap-Fusion-Hardware-Man8000097016-A-EN.pdf, 122 pages.
Shion, H., et al., "Meeting the Challenges of Implementing Accurate-Mass Mass Spectrometry for Biotherapeutic Development in Regulated/non-Regulated Environments", 2019 BioPharma Analytical Summit BioAccord Abstract. ASMS MS-in-QC, PowerPoint 24 pages.
International Preliminary Report on Patentability for International application No. PCT/GB2019/051510, dated Dec. 1, 2020, 7 pages.
Examination Report under Section 18(3) for Application No. GB1907722.1, dated Oct. 26, 2021, 4 pages.

* cited by examiner

MASS SPECTROMETER HAVING FRAGMENTATION REGION

CROSS-REFERENCE TO RELATED APPLICATION

This application claims priority from and the benefit of U.S. Patent Application No. 62/678,413 filed on May 31, 2018. The entire content of this application is incorporated herein by reference.

FIELD OF THE INVENTION

The present invention relates generally to mass spectrometers and in particular to spectrometers that are configured to fragment precursor ions to form fragment ions.

BACKGROUND

It is known in mass spectrometry to fragment precursor ions to produce fragment ions. For example, high energy (unstable) molecular ions formed in the ionisation source of a mass spectrometer may be subsequently fragmented. The fragment ions may be mass analysed so as to produce a pattern in the mass spectrum that can then be used to determine structural information of the precursor.

It is known to fragment ions using a number of different techniques. The fragmentation is usually performed in a dedicated fragmentation cell that is located within a low pressure vacuum chamber of the mass spectrometer. For example, a collision-induced-dissociation (CID) fragmentation cell may be arranged in the vacuum chamber, in which arrangement the fragmentation cell has a dedicated collision gas supply. Precursor ions are then accelerated into the collision gas, causing them to dissociate into fragment ions.

CID fragmentation is known to occur as ions are transferred from the ion source to the vacuum region of the mass spectrometer, since the ions pass through a relatively high pressure region. Such fragmentation is, however, generally not desired as it interferes with the post-source fragmentation within the collision cell(s) arranged in the vacuum chamber of the mass spectrometer and complicates the data processing and data interpretation. Therefore, the ion source conditions are tuned so as to minimise this type of fragmentation.

SUMMARY

From a first aspect the present invention provides a mass spectrometer comprising: a first vacuum chamber having an inlet aperture; a second vacuum chamber adjacent the first vacuum chamber; a differential pumping aperture separating the first and second vacuum chambers; an ion guide arranged in the first vacuum chamber for guiding ions from the inlet aperture to and through the differential pumping aperture, wherein the ion guide comprises a first portion configured to guide ions along a first axial path, a second portion configured to guide ions along a second different axial path, and a transition portion configured to urge ions from the first axial path onto the second axial path; and a voltage supply arranged and configured to apply voltages to electrodes in the spectrometer so as to accelerate ions through the first vacuum chamber; wherein the spectrometer is configured to operate in a first mode in which it maintains the gas pressure in the first vacuum chamber such that when the voltage supply causes ions to be accelerated the ions collide with gas in the first vacuum chamber and fragment to form fragment ions.

The form of the spectrometer, particularly the ion guide, allows for high gas loads to be handled in the first vacuum chamber and that the resulting increase in gas pressure may be used to fragment ions efficiently. The form of the ion guide and its arrangement within the spectrometer are therefore synergistic with the fragmentation technique described herein.

More specifically, the arrangement of the ion guide in a first of the two vacuum chambers (i.e. two-stage vacuum pumping), together with the form of the ion guide, enables the spectrometer to handle high gas loads entering the inlet aperture. As such, a relatively large inlet aperture may be provided, enabling a relatively high proportion of the ions from an ion source to enter the inlet aperture for subsequent analysis. The ion transmission rate through the first vacuum chamber may consequently be relatively high (e.g. a factor of 25 higher) as compared to instruments having conventional multipole ion guides in the first vacuum chamber. This enables the embodiments to have a relatively high sensitivity. Although a large inlet aperture would conventionally provide high chemical noise and be seen as undesirable, the ion guide of the embodiments of the present invention enables a high gas pressure and hence improved fragmentation, whilst also providing a good signal-to-noise ratio. The high signal-to-noise ratio is provided as the embodiments are able to separate neutral species and/or large cluster species from the analyte ions. More specifically, the ions are transferred from the first axial path of the ion guide to the second axial path of the ion guide, whereas the neutral species and/or large cluster species may continue along the first axial path. The ion guide therefore enables the ions to be onwardly transmitted into the second vacuum chamber and for the neutral species and/or large cluster species not to be. For example, the neutral species and/or large cluster species may be pumped away by the vacuum pump.

Although the form of the ion guide is known, it has previously been used for focussing a relatively diffuse ion cloud into the mass spectrometer (by using an ion guide having a radially larger first portion than the second portion). In such ion uses it has not been recognised that such an ion guide can handle higher gas loads and so is synergistic with the fragmentation technique described herein. In contrast, in these known techniques the operational conditions are selected such that the ions are collisionally cooled by the background gas such that they are better able to be focussed, i.e. the average energy of the ions is reduced. This is contrary to the techniques described herein, which deliberately increase the energy of the ions by accelerating them through the gas so as to cause them to fragment.

This form of the ion guide may alternatively have been contemplated for use in various ion manipulation devices (for transferring ions between axial paths). However, as described above, the synergy between the high gas load that the ion guide is able to handle and CID fragmentation has not previously been recognised in such techniques. Therefore, it has not been contemplated in such techniques to provide the ion guide in a first vacuum chamber that is upstream of a second (lower pressure) vacuum chamber, whilst also performing CID fragmentation in the first vacuum chamber. In contrast, in these conventional instruments having collision cells for fragmenting ions, the operating parameters are configured so as to avoid fragmentation in such a first vacuum chamber, which would otherwise complicate the data analysis of the fragment ions generated in the downstream collision cell.

The embodiments of the invention enable fragmentation in the ion guide in the first vacuum chamber. In contrast, conventional instruments provide a fragmentation cell in the lower pressure regions downstream of the first vacuum chamber, which then requires a dedicated gas supply to the fragmentation cell in order to provide the required gas pressure for CID fragmentation.

Furthermore, as the ion guide of the embodiments of the present invention enables a high gas pressure in the first vacuum chamber, the gas pressure may be significantly higher than the traditional dedicated fragmentation cells mentioned above. Therefore, the embodiments provide for more efficient fragmentation of molecular ions than traditional fragmentation cells.

According to embodiments of the present invention, the fragment ions may be generated in the first and/or second portions of the ion guide, and/or in the transition portion of the ion guide, and are transmitted by the ion guide to the differential pumping aperture.

The spectrometer may be configured to maintain the first vacuum chamber at a gas pressure selected from: ≥0.01 mBar; ≥0.05 mBar; ≥0.1 mBar; ≥0.2 mBar; ≥0.3 mBar; ≥0.4 mBar; ≥0.5 mBar; ≥0.6 mBar; ≥0.7 mBar; ≥0.8 mBar; ≥0.9 mBar; ≥1 mBar; ≥1.2 mBar; ≥1.4 mBar; ≥1.6 mBar; ≥1.8 mBar; or ≥2 mBar. The preferred range may be 1-2 mBar.

Said voltage supply may be configured to generate a DC static voltage gradient in the first vacuum chamber for accelerating ions to fragment.

The voltage gradient may be substantially along the first and/or second axial path.

The voltage gradient may be formed by applying different voltages to at least the upstream and downstream electrodes of the ion guide. Different voltages may be applied to all of the different axial sections of the ion guide so as to form the voltage gradient.

The voltage gradient may be varied with time, e.g. to optimise fragmentation for different types of ions (e.g. having different molecular sizes and/or structures). This may be varied during a single experimental run or between different experimental runs. For example, for experiments such as peptide mapping experiments there are many different types of molecules in a single sample and therefore a range of voltage gradients may be applied in a single experimental run. The voltage may be incremented in steps to affect the voltage gradient, e.g. by a unit of one volt at a time.

The voltage gradient may be repeatedly scanned or stepped during a single experimental run. The voltage gradient may be scanned or stepped over the same range, or different ranges. For example, the voltage gradient may be scanned or stepped over a range at a rate of between 0.2 Hz and 20 Hz. In the example in which the rate is 0.2 Hz the voltage gradient will be scanned or stepped across the range in 5 second, whilst at 20 Hz the scanning or stepping will take 0.05 seconds.

The potential drop of the voltage gradient at any given time may be between 60-150 V. However, other voltage drops are contemplated such as 50-160 V, 40-170 V, 30-180 V, 20-190 V or 10-200 V. The voltage drop may be selected (e.g. automatically by the spectrometer) based on user input identifying target ions to be fragmented.

Alternatively, or additionally, the voltage supply may be configured to travel one or more potential barrier (e.g. DC barrier) along the first and/or second ion guide portion so as to urge the ions to collide with the gas and fragment. This may be performed by successively applying one or more transient DC voltage to successive electrodes along the ion guide. The one or more DC potential barrier may be repeatedly travelled along the ion guide. The one or more DC potential barrier may be travelled along the ion guide in a direction from the inlet to the differential pumping aperture of the first vacuum chamber, or from the differential pumping aperture to the inlet of the first vacuum chamber (e.g. opposing the gas flow to cause higher collision energies).

The inlet aperture may separate the first vacuum chamber from a region that is at higher pressure than the first vacuum chamber, in use. Said region may be an atmospheric pressure region and the inlet aperture may be an atmospheric pressure interface.

The spectrometer may comprise a source of ions in the said region that is at higher pressure than the first vacuum chamber. Said source of ions may be an atmospheric pressure ion source.

The inlet aperture may have a diameter of: ≥0.5 mm; ≥0.55 mm; ≥0.6 mm; ≥0.65 mm; ≥0.7 mm; ≥0.75 mm; ≥0.8 mm; ≥0.85 mm; ≥0.9 mm; ≥0.95 mm; or ≥1 mm.

The ion guide enables a high gas load in the first vacuum chamber and so a relatively large inlet aperture is able to be used, enabling an increased ion transmission through the inlet aperture and into the first vacuum chamber.

A central axis of the first axial path of the ion guide may pass through said inlet aperture and/or a central axis of the first axial path of the ion guide may be coaxial with a central axis said inlet aperture.

A central axis of the second axial path of the ion guide may pass through said differential pumping aperture and/or a central axis of the second axial path of the ion guide may be coaxial with a central axis said differential pumping aperture.

The first vacuum chamber may further comprise a gas pumping port for evacuating the first vacuum chamber of gas, and at least part of the second portion of the ion guide may be shielded from the gas pumping port by a barrier.

The barrier may be configured such that the majority of the gas flow through the first vacuum chamber passes from said inlet aperture to the gas pumping port without passing through said at least part of the second portion of the ion guide.

The first vacuum chamber may comprise a gas pumping port for evacuating the first vacuum chamber of gas, and a central axis of the first axial path of the ion guide may pass through said gas pumping port and/or a central axis of the first axial path of the ion guide may be coaxial with a central axis said gas pumping port.

The first portion of the ion guide may have a larger radial cross-section than the second portion of the ion guide.

The ion guide may be configured such that the first axial path of the ion guide is substantially parallel to and displaced from the second axial path of the ion guide.

The first and/or second portion of the ion guide may comprise a plurality of electrodes, wherein the plurality of electrodes are axially spaced electrodes and each electrode is an electrode having an aperture through which ions are transmitted in use. However, it is contemplated that other electrodes may be used, such as multipole or plate electrodes.

The transition portion of the ion guide may comprise: at least one first electrode, each of which only partially surrounds the first axial path and has a radial opening in its side that is directed towards the second axial path; at least one second electrode, each of which only partially surrounds the second axial path and has a radial opening in its side that is directed towards the first axial path; and electrodes for providing a potential difference so as to urge ions in the direction from the first axial path to the second axial path.

The spectrometer may comprise one or more RF voltage supply for supplying RF voltages to the electrodes of the first and/or second portions of the ion guide, and/or to the transition portion of the ion guide, for radially confining ions within these portions.

Different phases of an RF voltage may be applied to axially adjacent electrodes in each portion, e.g. opposite phases.

The spectrometer may comprise a mass and/or ion mobility analyser in the second vacuum chamber or in a further vacuum chamber downstream of the second vacuum chamber.

The spectrometer is configured to pump the second vacuum chamber to a lower pressure than the first vacuum chamber. If said further vacuum chamber is provided, a differential pumping aperture is provided that separates the second vacuum chamber from the further vacuum chamber, and the spectrometer is configured to pump the further vacuum chamber to a lower pressure than the second vacuum chamber.

The mass analyser may be a Time of Flight mass analyser.

The mass spectrometer may be configured to operate in a second mode in which the pressure in the first vacuum chamber and said voltage supply are controlled such that ions are fragmented at a substantially lower rate than in the first mode. For example, substantially no ions may be fragmented in the second mode.

The pressure in the first vacuum chamber may be maintained the same in the first and second modes, or the pressure may be higher in the first mode than the second mode.

The voltage supply may be configured to change the voltages supplied to the electrodes between the first and second modes such that ions are accelerated at a higher rate in the first mode than in the second mode.

The spectrometer may be configured to alternate between the first and second modes, e.g. during a single experimental run.

The spectrometer may be configured to mass analyse fragment ions in the first mode, mass analyse precursor ions in second mode, and correlate the fragment ions analysed in the first mode with their respective precursor ions analysed in the second mode.

The method may correlate the fragment ions analysed in the first mode with their respective precursor ions analysed in the second mode by: (i) matching the ion signal intensity profiles of fragment ions (as a function of time) with ion signal intensity profiles of precursor ions (as a function of time); and/or (ii) matching the fragment ions to their precursor ions based on the times at which the fragment and precursor ions are detected (e.g. based on the detected elution times of the ions in the experiment(s)).

The present invention also provides a method of mass spectrometry comprising:

providing a mass spectrometer as described above; transmitting ions through said inlet aperture into said ion guide; guiding ions through said ion guide along said first axial path, through said transition portion and along said second axial path to said differential pumping aperture;

operating the spectrometer in the first mode in which the pressure in the first vacuum chamber and said voltage supply are controlled such that ions are accelerated by the voltage supply so as to collide with gas in the first vacuum chamber and fragment to form fragment ions.

The first vacuum chamber is pumped to a first pressure and the second vacuum chamber may be pumped to a second, lower pressure.

The inlet aperture may separate the first vacuum chamber from a region that is at higher pressure than the first vacuum chamber.

The method may comprise evacuating gas from the first vacuum chamber through a gas pumping port, wherein at least part of the second portion of the ion guide is shielded from the gas pumping port by a barrier so that the majority of the gas flow through the first vacuum chamber passes from said inlet aperture to the gas pumping port without passing through said at least part of the second portion of the ion guide.

The method may comprise mass and/or ion mobility analysing ions in the second vacuum chamber or in a further vacuum chamber downstream of the second vacuum chamber.

The method may comprise operating the spectrometer in a second mode in which the pressure in the first vacuum chamber and said voltage supply are controlled such that ions are fragmented at a substantially lower rate than in the first mode. For example, substantially no ions may be fragmented in the second mode.

The pressure in the first vacuum chamber may be maintained the same in the first and second modes, or the pressure may be higher in the first mode than the second mode.

The voltage supply may change the voltages supplied to the electrodes between the first and second modes such that ions are accelerated at a higher rate in the first mode than in the second mode.

The method may comprise alternating between the first and second modes, e.g. during a single experimental run.

The method may comprise mass analysing fragment ions in the first mode, mass analysing precursor ions in second mode, and correlating the fragment ions analysed in the first mode with their respective precursor ions analysed in the second mode.

The method may correlate the fragment ions analysed in the first mode with their respective precursor ions analysed in the second mode by: (i) matching the ion signal intensity profiles of fragment ions with ion signal intensity profiles of precursor ions; and/or (ii) matching the fragment ions to their precursor ions based on the times at which the fragment and precursor ions are detected.

Embodiments of the present invention provide a method of identifying biomolecules using the above-described method of mass spectrometry. Ions of the biomolecules are transmitted through the inlet aperture, into the ion guide and are accelerated by the voltage supply so as to collide with gas in the first vacuum chamber and fragment to form the fragment ions.

The biomolecules may be peptides.

The method may comprise identifying the peptides by peptide mapping.

The peptide mapping may comprise: mass analysing the fragment ions; comparing the resulting first mass spectral data to a database, wherein the database includes a plurality of peptides that are each associated with second mass spectral data for a plurality of fragment ions of that peptide; determining that said first mass spectral data matches said second mass spectral data for one of said peptides in the database; and identifying that peptide as a peptide that has been mass analysed by the mass spectrometer.

The method may comprise digesting a protein or peptide and ionising the resulting peptides so as to form peptide ions, and then transmitting the peptide ions through said inlet aperture.

The protein or peptide may be tryptically digested, or digested with a different enzyme.

The method may comprise digesting a monoclonal antibody and ionising the resulting peptides so as to form peptide ions, and then transmitting peptide ions through said inlet aperture.

The method may comprise separating said resulting peptides before the step of ionising the peptides so that ions of different peptides are transmitted into the ion guide at different times.

The peptides may be separated by liquid chromatography.

The voltage supply may generate a DC voltage gradient in the first vacuum chamber that accelerates the ions to fragment them into said fragment ions; wherein a range of different DC voltage gradients are provided during a single experimental run.

The techniques described herein may increase the fragmentation efficiency and sensitivity, for example, for biomolecules to aid biotherapeutics characterization and critical quality attributes (CQAs) monitoring.

Accordingly, the present invention also provides a method of biotherapeutics characterisation comprising: (i) providing a mass spectrometer comprising: a first vacuum chamber having an inlet aperture; a second vacuum chamber adjacent the first vacuum chamber; a differential pumping aperture separating the first and second vacuum chambers; an ion guide arranged in the first vacuum chamber for guiding ions from the inlet aperture to and through the differential pumping aperture, wherein the ion guide comprises a first portion configured to guide ions along a first axial path, a second portion configured to guide ions along a second different axial path, and a transition portion configured to urge ions from the first axial path onto the second axial path; and a voltage supply arranged and configured to apply voltages to electrodes in the spectrometer so as to accelerate ions through the first vacuum chamber; (ii) transmitting ions through said inlet aperture into said ion guide; (iii) guiding ions through said ion guide along said first axial path, through said transition portion and along said second axial path to said differential pumping aperture; and (iv) operating the spectrometer in the first mode in which the pressure in the first vacuum chamber and said voltage supply are controlled such that the ions are accelerated by the voltage supply so as to collide with gas in the first vacuum chamber and fragment to form fragment ions.

BRIEF DESCRIPTION OF THE DRAWINGS

Various embodiments will now be described, by way of example only, and with reference to the accompanying drawings in which.

DETAILED DESCRIPTION

In mass spectrometry, analyte ions are often generated by relatively high pressure ion sources, e.g. by atmospheric pressure ion sources. It is then necessary to transmit these ions into a vacuum region of the mass spectrometer, since the processing or analysis of the ions is required to be performed at relatively low vacuum pressures.

Figure 1:
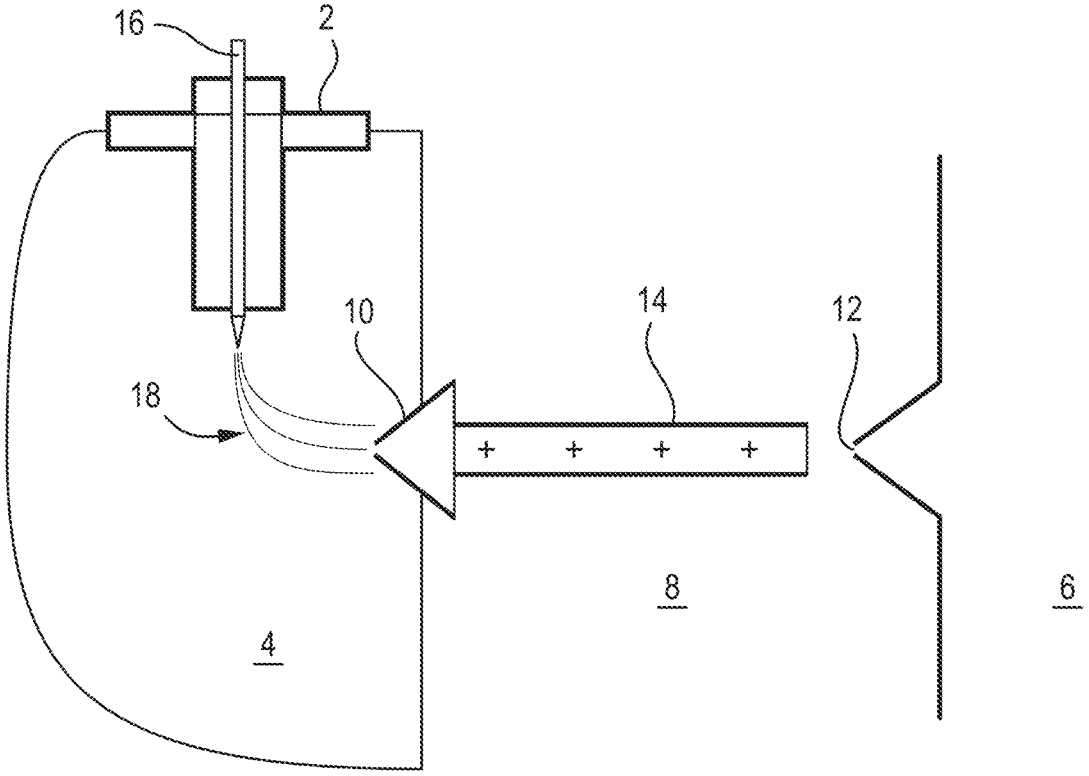
FIG. 1 schematically illustrates part of a known mass spectrometer.

FIG. 1 schematically illustrates a known arrangement comprising an electrospray ionisation (ESI) probe 2 arranged in an atmospheric pressure region 4, a low pressure vacuum chamber 6 of a mass spectrometer, and an intermediate pressure chamber 8 arranged between the atmospheric pressure region 4 and the vacuum chamber 6 of the mass spectrometer. A cone 10 is arranged between the atmospheric pressure region 4 and the intermediate pressure chamber 8 so that the intermediate pressure chamber 8 is able to be maintained at a lower pressure than the atmospheric pressure region 4, and a differential pumping aperture 12 is arranged between the vacuum chamber 6 and the intermediate pressure chamber 8 so that the vacuum chamber is able to be maintained at a lower pressure than the intermediate pressure chamber. A multipole ion guide 14 is arranged in the intermediate pressure chamber 8 for guiding ions received through the cone 10 towards and through the differential pumping aperture 12.

In operation, the intermediate pressure chamber 8 is pumped to a lower pressure than the atmospheric pressure region 4, and the vacuum chamber 6 is pumped to a lower pressure than the intermediate pressure chamber 8. Analyte solution is then delivered to the capillary 16 of the ESI probe 2 and is sprayed from the tip thereof so as to produce analyte ions 18 in the atmospheric pressure region 4. The analyte ions 18 then pass through the cone 10 and into the ion guide 14 in the intermediate pressure chamber 8. The ion guide 14 guides the ions through the intermediate pressure chamber and through the differential pumping aperture 12 into the vacuum chamber 6. The ions may then be fragmented in the vacuum chamber 6, or in a further downstream vacuum chamber of the spectrometer which may be pumped to an even lower pressure.

Figure 2A:
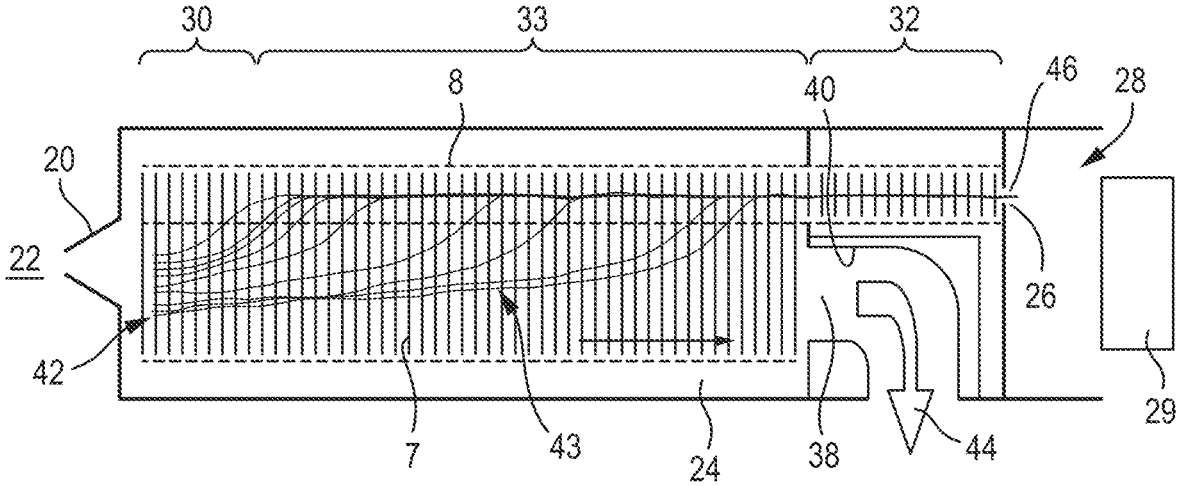
FIG. 2A shows part of a mass spectrometer according to an embodiment of the present invention.

FIG. 2A shows an embodiment of the present invention that is similar to that shown in FIG. 1, except that the multipole rod set ion guide has been replaced by another type of ion guide that guides ions along a first axial path and then onto and along a second axial path that is displaced from the first axial path, and voltages are applied to the instrument so as to accelerate the ions in the background gas so as to cause them to fragment via CID fragmentation.

In the embodiment of FIG. 2A, the sampling cone 20 separates the relatively high pressure region 22 (such as an atmospheric pressure region) from the first vacuum chamber 24. An electrospray ionisation (ESI) probe, or other source of ions, may be arranged in high pressure region 22. A differential pumping aperture 26 is arranged between the first vacuum chamber 24 and a second vacuum chamber 28 so that the second vacuum chamber 28 is able to be maintained at a lower pressure than the first vacuum chamber 24. The ion guide is arranged in the first vacuum chamber 24 for guiding ions received through the sampling cone 20 towards and through the differential pumping aperture 26, as will be described in more detail below. A mass analyser 29, such as an orthogonal acceleration Time of Flight mass analyser, may be arranged in the second vacuum chamber 28 for analysing ions transmitted through the differential pumping aperture 26.

The ion guide comprises a first portion 30 for guiding ions along a first axial path, a second portion 32 for guiding ions along a second axial path (which may be parallel to and displaced the first axial path), and a transition portion 33 for transferring ions from the first axial path to the second axial path. In the depicted embodiment, each of the first and second ion guide portions 20,32 comprises a plurality of axially separated apertured electrodes (e.g. ring electrodes) for radially confining the ions along their respective axial paths. RF voltages are applied to these electrodes so as to radially confine the ions. For example, different (e.g. opposite) phases of an RF voltage supply may be applied to adjacent apertured electrodes in the known manner so as to radially confine the ions.

Figure 2B:
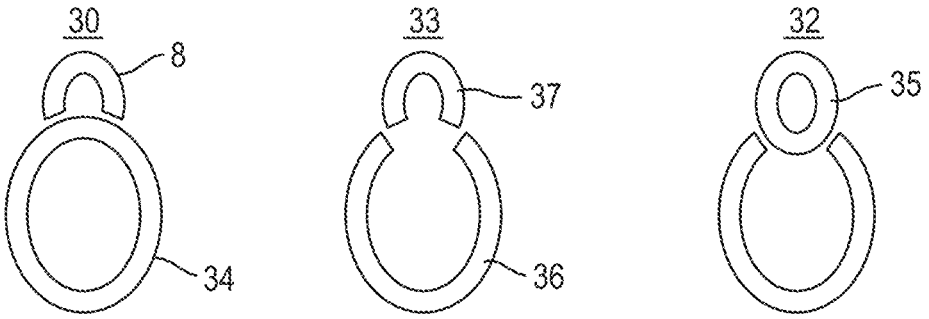
FIG. 2B shows cross-sectional views through different portions of the ion guide shown in FIG. 2A.

FIG. 2B shows three cross-sectional views of the electrode arrangement in the ion guide at different axial points along the ion guide. View 30 shows the electrode arrangement proximate the sampling cone 20, where the ions are confined in the first portion 30 of the ion guide to the first axial path by the apertured electrodes 34. View 32 shows the electrode arrangement proximate the differential pumping aperture 26, where the ions are confined in the second portion of the ion guide 32 to the second axial path by the apertured electrodes 35. View 33 shows the electrode arrangement in the transition region 33 of the ion guide, in which the ions are transferred from the first axial path of the first ion guide portion 30 to the second axial path of the second ion guide portion 32. This transfer may be achieved by: providing one or more electrodes 36 in the transition region, each of which only partially encircles the first axial path and has a radial opening in its side that is directed towards the second axial path (e.g. an arc-shaped electrode); providing one or more electrodes 37 in the transition region, each of which only partially encircles the second axial path and has a radial opening in its side that is directed towards the first axial path (e.g. an arc-shaped electrode); and urging ion from the first axial path, through the radial openings in the electrodes, and onto the second axial path. This urging of the ions may be performed by providing an electrical potential difference, e.g. by applying voltages to the electrodes in the transition region so as to provide a potential difference in the radial direction.

Figure 2C:
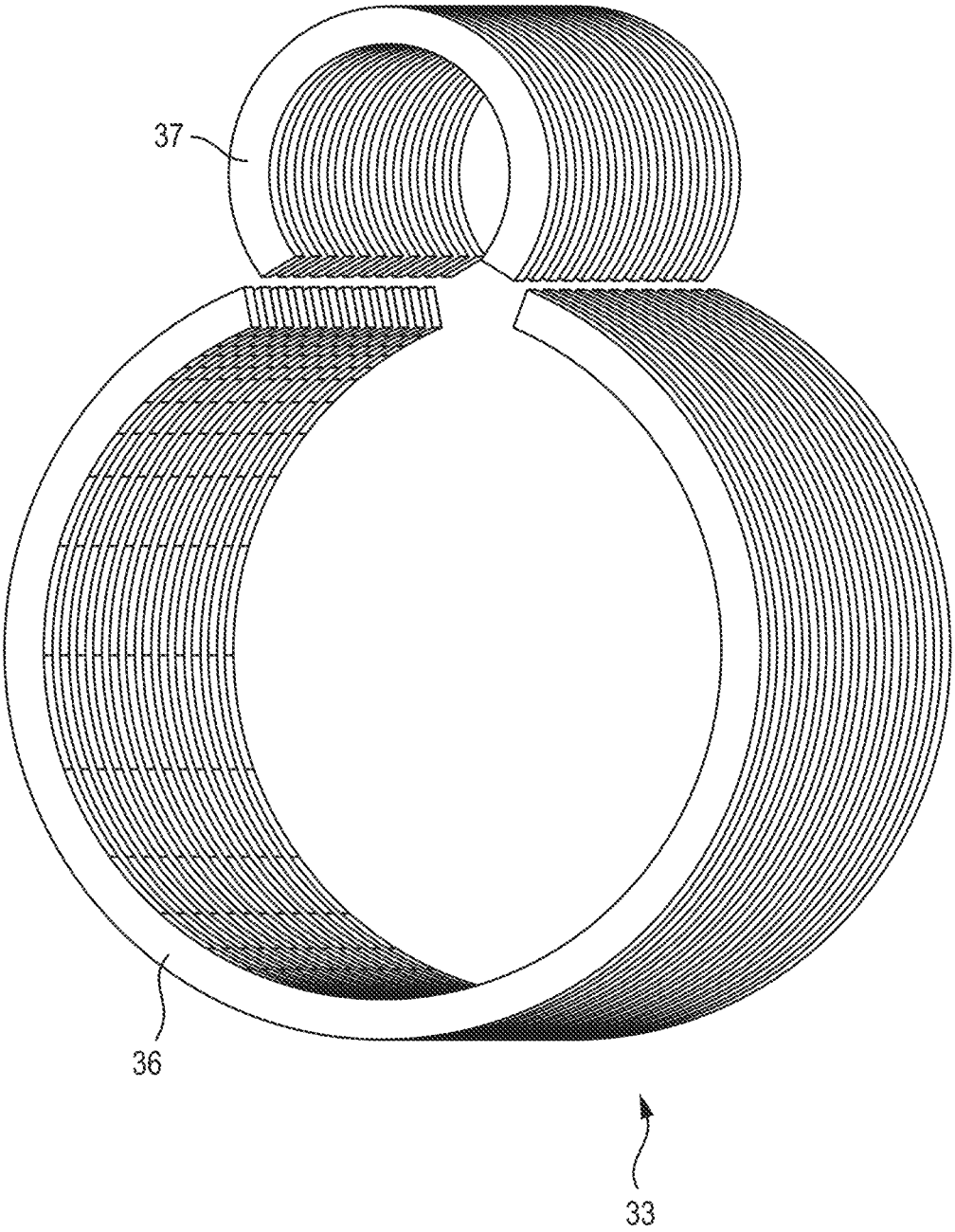
FIG. 2C shows a perspective view of the transition portion of the ion guide.

FIG. 2C shows a perspective view of the electrode arrangement in the transition region.

Referring back to FIG. 2A, the first ion guide portion 30 may be arranged in the first vacuum chamber 24 such that the aperture of the sampling cone 20 is aligned (e.g. coaxial) with the first axial path defined by the first ion guide portion 30. The second ion guide portion 32 may be arranged in the first vacuum chamber 24 such that the aperture in the differential pumping aperture 26 is aligned (e.g. coaxial) with the second axial path defined by the second ion guide portion 32.

A vacuum pump is provided for evacuating the first vacuum chamber 24 through a gas pumping port 38. The opening of the gas pumping port 38 may be aligned (e.g. coaxial) with the first axial path of the first ion guide portion 30. The end of the ion guide formed by the second portion 32 may be physically shielded from the gas pumping port 38 by a barrier 40.

In operation, ions are generated in high pressure region 22. The pressure differential between the high pressure region 22 and the first vacuum chamber 24 causes gas and ions to pass through the cone 20 and into the first vacuum chamber 24, whereby the gas and ions tend to expand into the lower pressure region. The ions enter into the first portion 30 of the ion guide and are radially confined thereby, but may be relatively diffuse, as shown by ion cloud 42. The ions are driven axially along the first portion 32 of the ion guide, at least partially by the gas flow towards the gas pumping port 38. When ions reach the transition portion 33 of the ion guide, they are urged in the radial direction and onto the second axial path defined by the second portion 32 of the ion guide, as shown by ion trajectories 43. As described above, this may be caused by applying a potential difference in the radial direction. As a result, ions are caused to migrate from the first ion guide portion 30 to the second ion guide portion 32. In contrast, the majority of the gas flow continues substantially along the axis defined by the first ion guide portion 30 towards and through the gas pumping port 38, as shown by arrow 44. Ions are therefore radially confined in the second ion guide portion 32 and travel along the second axial path towards the differential pumping aperture 26, whereas the majority of the gas is routed in a different direction towards the gas pumping port 38. At least part of the second portion 32 of the ion guide may be shielded from the pumping port by a barrier 40, so that the gas flow towards the pumping port 38 is directed away from the second axial path of the second ion guide portion 32.

The second ion guide portion 32 may have a smaller radial cross-section than the first portion 30 so that the ions are radially compressed in the second portion as compared to the first portion, as shown by ion beam 46. Ions are then guided by the second ion guide portion 32 through the differential pumping aperture 26 and into the second vacuum chamber 28.

Ion guides of the type described above are known for converting a diffuse ion cloud into a more compact ion cloud. However, the inventors have recognised that the ion guide in the above-described arrangement is able to handle relatively high gas loads (e.g. since the ion guide initially conveys the ions with the gas flow towards the pumping port and then moves the ions out of the gas flow), and that the ion guide therefore enables the first vacuum chamber 24 to be operated at relatively high pressures such that efficient CID fragmentation may be performed in this region.

Embodiments of the invention therefore accelerate the ions through the gas in the first vacuum chamber 24 so as to cause collisions between the ions and the gas molecules (and other species) that result in CID fragmentation of the precursor ions to form fragment ions. The precursor ions may be accelerated through the gas by a static DC electric field. For example, a DC voltage gradient may be arranged between a point in the first vacuum chamber 24 towards the cone 20 and a point towards the differential pumping aperture 26, e.g. by applying different DC voltages to these elements and/or to electrodes of the ion guide. The DC voltage gradient may be arranged along the first and/or second axis of the ion guide (and/or the transition region 33), e.g. by applying different voltages to electrodes of the ion guide at different axial locations. Alternatively, or additionally, ions may be accelerated into CID fragmentation with the gas by travelling one or more DC potential barrier along the first and/or second ion guide portions 30,32 so as to urge the ions to collide with the gas molecules. This may be performed by successively applying one or more transient DC voltage to successive electrodes along the ion guide. The one or more DC potential barrier may be repeatedly travelled along the ion guide. The one or more DC potential barrier may be travelled along the ion guide in a direction from the ion entrance (cone 20) to the ion exit (differential pumping aperture 26) of the first vacuum chamber 24, or from the ion exit to the ion entrance of the first vacuum chamber 24 (i.e. opposing the gas flow to cause higher collision energies).

As described above, the embodiments allow the handling of large gas loads into the instrument, enabling the use of a relatively large sampling cone 20 to capture significantly more ions from the upstream high pressure region 22. For example, the sampling cone 20 may have a diameter of about 0.8 mm. The ion transmission into the instrument and signal to noise ratio of the instrument are therefore improved. For example, the ion transmission may be increased by a factor of at least 25 and the signal to noise ratio may be increased by a factor of at least 5, as compared to arrangements having conventional multipole ion guides.

The embodiments provide increased collisions of the ions with the gas molecules due to the high gas load, enabling a high sequence coverage of analytes. For example, close to 100% sequence coverage was obtained in a monoclonal antibody (mAb) tryptically digested peptide mapping LC-MS experiment.

By way of example only, LC-MS and LC-MS/MS experiments for NIST mAb tryptically digested peptide mapping will now be described. NIST monoclonal antibody Reference Material 8671 (NIST mAb) was reduced and tryptically digested, lyophilized. The contents of one vial were reconstituted in water before injection. Analyses of this sample were performed using a Waters ACQUITY UPLC H-Class Bio LC system coupled to a single stage orthogonal acceleration TOF system (i.e. in which a TOF mass analyser is located in the second vacuum chamber). The separation method and the mass spectrometry conditions are outlined below.

LC Conditions:

Columns: ACQUITY UPLC Peptide BEH C18 Column, 300 Å, 1.7 μm, 2.1 mm×100 mm

Mobile Phase A: 0.1% (w/v) Formic acid in water

Mobile Phase B: 0.1% (w/v) Formic acid in acetonitrile

Column Temperature: 60° C.

Injection Volume: 2 μL

Sample Concentration: 0.2 μg/μL

Sample Diluent: water

UV Detection: 214 nm (20 Hz)

Gradient Table:

| Time(min) | Flow Rate(mL/min) | % A | % B | Curve |
|---|---|---|---|---|
| Initial | 0.200 | 99.0 | 1.0 | Initial |
| 1.00 | 0.200 | 99.0 | 1.0 | 6 |
| 60.00 | 0.200 | 60.0 | 40.0 | 6 |
| 61.00 | 0.200 | 25.0 | 75.0 | 6 |
| 63.00 | 0.200 | 25.0 | 75.0 | 6 |
| 64.00 | 0.200 | 99.0 | 1.0 | 6 |
| 75.00 | 0.200 | 99.0 | 1.0 | 6 |

Figure 3:
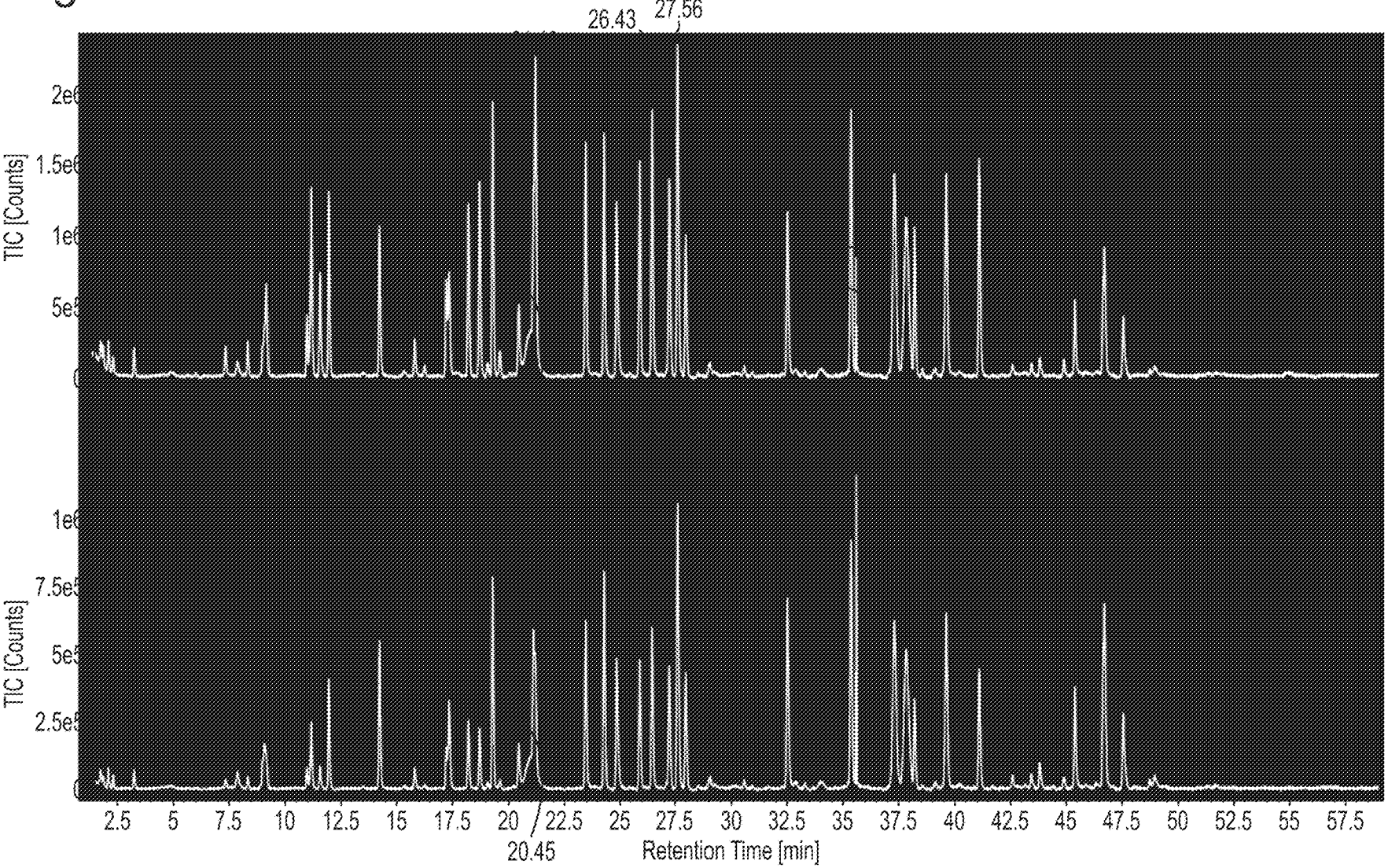
FIG. 3 shows the ion current as a function of time for an embodiment of the present invention, in a low fragmentation mode (upper plot) and a high fragmentation mode (lower plot)

FIG. 3 shows the total ion current as a function of LC retention time for both a low fragmentation mode (upper plot) and a high fragmentation mode (lower plot). In the low fragmentation mode the voltage applied to the differential pumping aperture 26 was set such that the ions were not accelerated into a significant level of CID fragmentation. As such, the ion signal is primarily due to precursor ions. In the high fragmentation mode the voltage applied to the differential pumping aperture 26 was set such that the ions were accelerated through a potential difference into a significant level of CID fragmentation. As such, the ion signal contains significant contributions from fragment ions.

Figure 4:
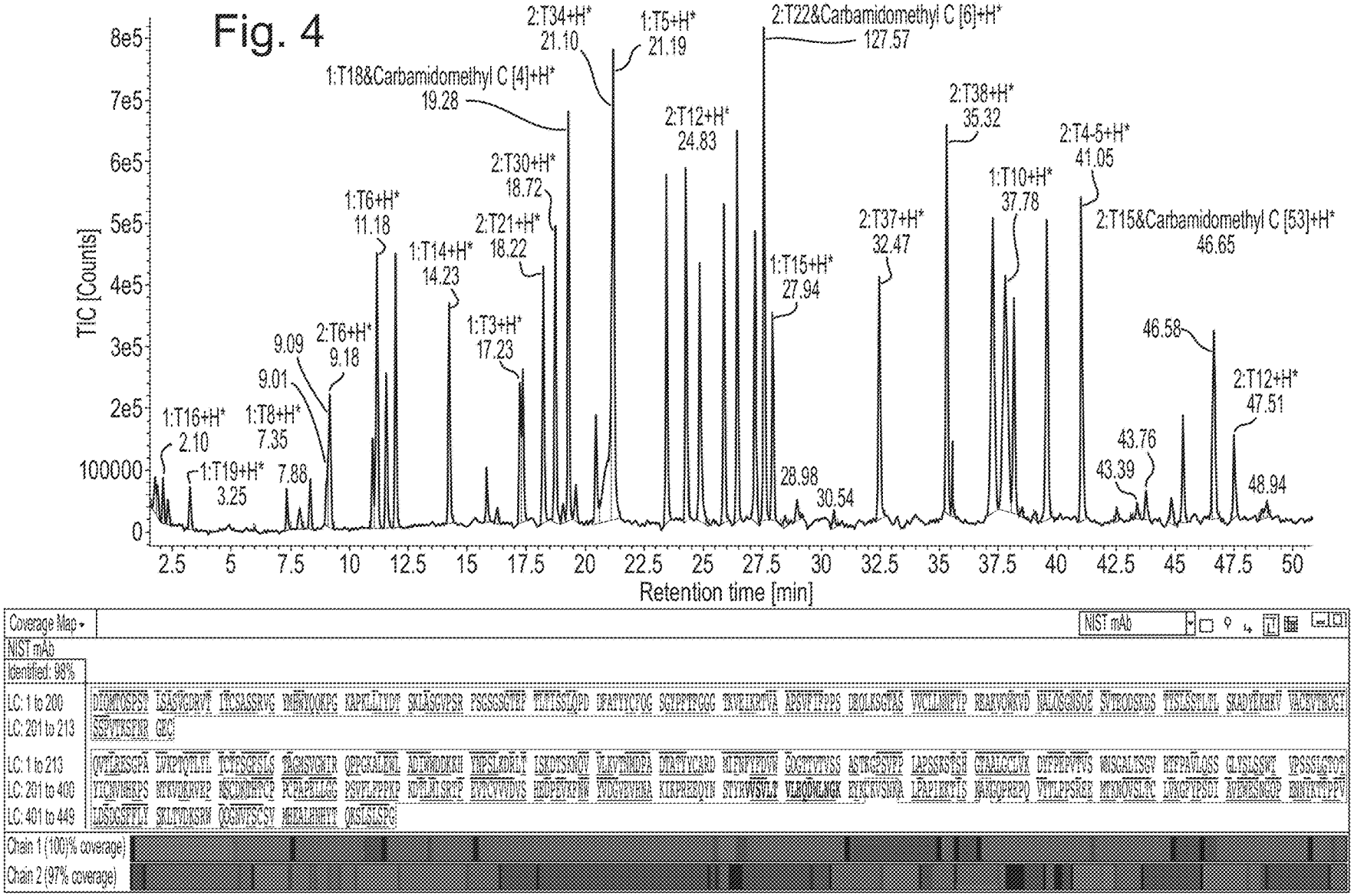
FIG. 4 shows the results of a peptide mapping experiment.

FIG. 4 shows the 98% coverage maps of the peptide mapping experiment with the NIST mAb sample.

Figure 5:
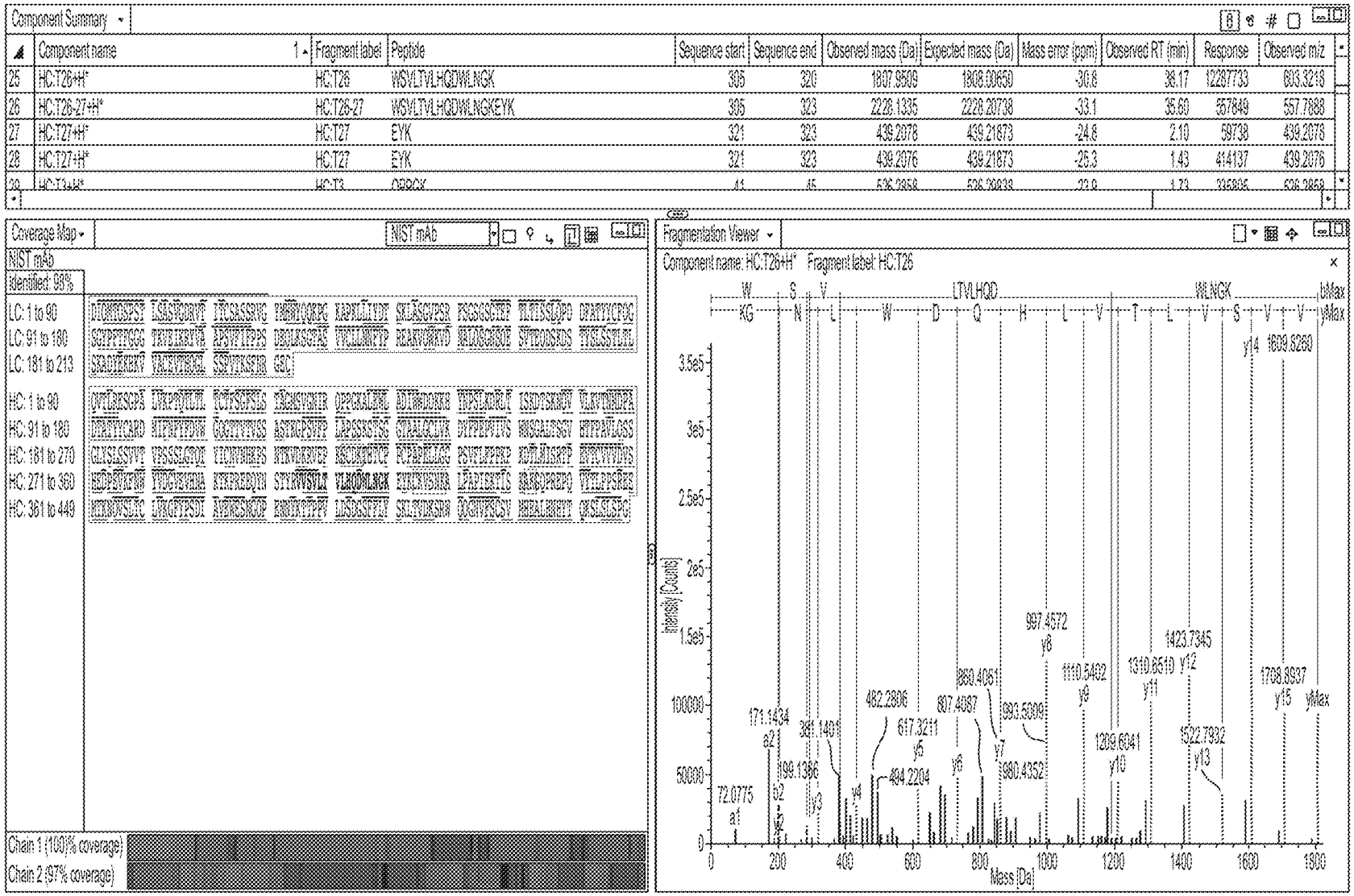
FIG. 5 shows MS/MS fragmentation quality of an embodiment of the present invention.

FIG. 5 shows MS/MS fragmentations of one of the NIST mAb tryptic peptide and demonstrates the high MS/MS fragmentation quality of the system.

The experiment shows that fragmentation is performed more efficiently than in arrangements having conventional multipole ion guides, and the technique therefore produces fragments that have close to 100% sequence matching coverage (e.g. for 150 KDa monoclonal antibody molecules).

Although a specific example has been described above, the techniques described herein are applicable to the fragmentation of other species and forms of molecules. For example, embodiments are contemplated wherein the fragmentation and analysis of small pharmaceutical drugs, pesticides in food, environmental contaminants, or other biological molecules (such as lipids and oligonucleotides, synthetic polymers, etc.) are performed.

Although the present invention has been described with reference to preferred embodiments, it will be understood by those skilled in the art that various changes in form and detail may be made without departing from the scope of the invention as set forth in the accompanying claims.

For example, although the embodiments described above include an ion guide having two conjoined ion guide portions comprising ring electrodes, other embodiments are contemplated.

Figure 6:
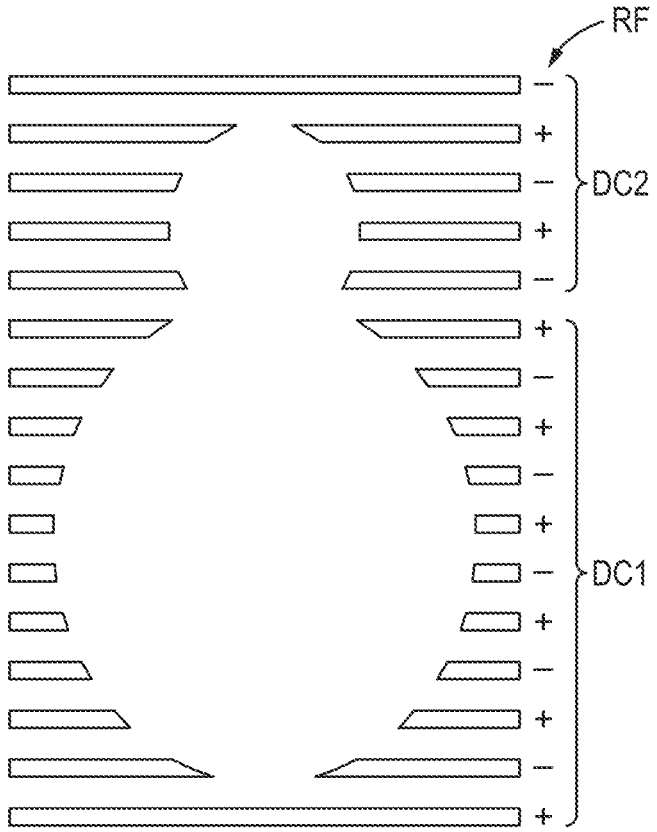
FIG. 6 shows a cross-section through the transition region of an ion guide according to an embodiment wherein the ion guide is formed from stacked plate electrodes.

FIG. 6 shows a cross-section through the ion guide (at the transition region 33) in an embodiment wherein the ion guide is formed from stacked plate electrodes instead of ring electrodes. Adjacent plate electrodes may be maintained at different (e.g. opposite) phases of an RF voltage. The plate electrodes which define the first axial path of the ion guide may be maintained at a first DC voltage DC1. The plate electrodes which define the second axial path of the ion guide may be maintained at a second, different voltage DC2.

Figure 7:
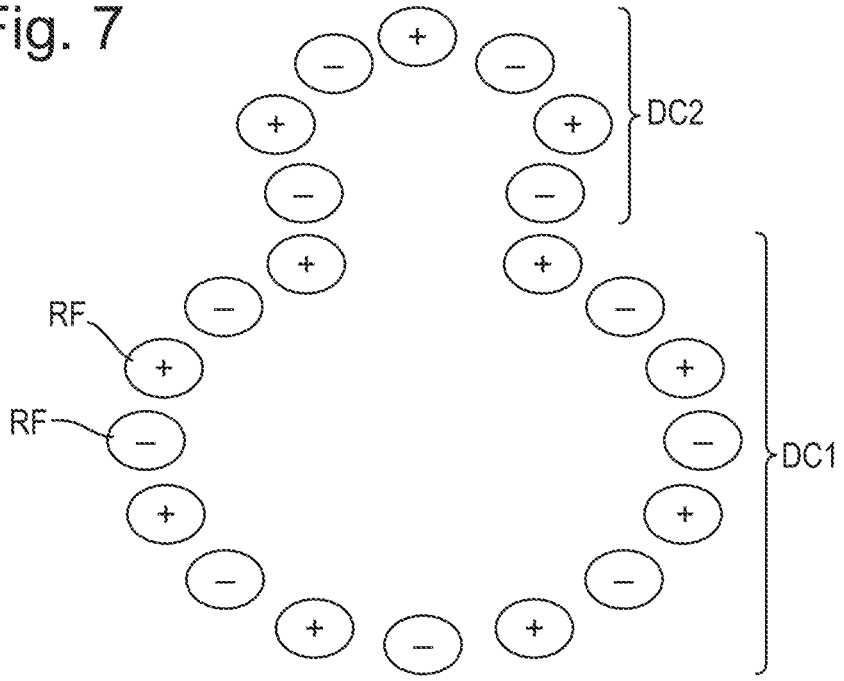
FIG. 7 shows a cross-section through the transition region of an ion guide according to an embodiment wherein the ion guide is formed from rod electrodes.

FIG. 7 shows a cross-section through the ion guide (at the transition region 33) in an embodiment wherein the ion guide is formed from rod sets. Adjacent rods may be maintained at different (e.g. opposite) phases of an RF voltage. The rod electrodes which define the first axial path of the ion guide may be maintained at a first DC voltage DC1. The rod electrodes which define the second axial path of the ion guide may be maintained at a second, different voltage DC2.

The invention claimed is:

1. A method of identifying biomolecules by mass spectrometry comprising:

(i) providing a mass spectrometer comprising: a first vacuum chamber having an inlet aperture; a second vacuum chamber adjacent the first vacuum chamber; a differential pumping aperture separating the first and second vacuum chambers; an ion guide arranged in the first vacuum chamber for guiding ions from the inlet aperture to and through the differential pumping aperture, wherein the ion guide comprises a first portion configured to guide ions along a first axial path, a second portion configured to guide ions along a second different axial path, and a transition portion configured to urge ions from the first axial path onto the second axial path; and a voltage supply arranged and configured to apply voltages to electrodes in the spectrometer so as to accelerate ions through the first vacuum chamber;

(ii) transmitting ions of said biomolecules through said inlet aperture into said ion guide;

(iii) guiding ions through said ion guide along said first axial path, through said transition portion and along said second axial path to said differential pumping aperture; and (iv) operating the spectrometer in a first mode in which the pressure in the first vacuum chamber and said voltage supply are controlled such that the ions are accelerated by the voltage supply so as to collide with gas in the first vacuum chamber and fragment to form fragment ions.

2. The method of claim 1, wherein the biomolecules are peptides.

3. The method of claim 2, comprising identifying the peptides by peptide mapping.

4. The method of claim 2, comprising digesting a protein or peptide and ionising the resulting peptides so as to form peptide ions, and then transmitting the peptide ions through said inlet aperture.

5. The method of claim 4, comprising digesting a monoclonal antibody and ionising the resulting peptides so as to form peptide ions, and then transmitting peptide ions through said inlet aperture.

6. The method of claim 4, comprising separating said resulting peptides before the step of ionising the peptides so that ions of different peptides are transmitted into the ion guide at different times.

7. The method of claim 1, wherein said voltage supply generates a DC voltage gradient in the first vacuum chamber that accelerates the ions to fragment them into said fragment ions; and wherein a range of different DC voltage gradients are provided during a single experimental run.

8. The method of claim 1, wherein the first vacuum chamber is pumped to a first pressure and the second vacuum chamber is pumped to a second, lower pressure.

9. The method of claim 1, wherein the inlet aperture separates the first vacuum chamber from a region that is at higher pressure than the first vacuum chamber and that contains an ion source for generating the ions.

10. The method of claim 1, wherein the inlet aperture has a diameter of: ≥0.5 mm; ≥0.55 mm; ≥0.6 mm; ≥0.65 mm; ≥0.7 mm; ≥0.75 mm; ≥0.8 mm; ≥0.85 mm; ≥0.9 mm; ≥0.95 mm; or ≥1 mm.

11. The method of claim 1, wherein a central axis of the first axial path of the ion guide passes through said inlet aperture and/or wherein a central axis of the first axial path of the ion guide is coaxial with a central axis said inlet aperture.

12. The method of claim 1, wherein a central axis of the second axial path of the ion guide passes through said differential pumping aperture and/or wherein a central axis of the second axial path of the ion guide is coaxial with a central axis said differential pumping aperture.

13. The method of claim 1, comprising evacuating gas from the first vacuum chamber through a gas pumping port, wherein at least part of the second portion of the ion guide is shielded from the gas pumping port by a barrier so that gas flow through the first vacuum chamber passes from said inlet aperture to the gas pumping port without passing through said at least part of the second portion of the ion guide.

14. The method of claim 1, wherein the first vacuum chamber comprises a gas pumping port for evacuating the first vacuum chamber of gas, and wherein a central axis of the first axial path of the ion guide passes through said gas pumping port and/or wherein a central axis of the first axial path of the ion guide is coaxial with a central axis said gas pumping port.

15. The method of claim 1, wherein the first portion of the ion guide has a larger radial cross-section than the second portion of the ion guide.

16. The method of claim 1, comprising mass and/or ion mobility analysing ions in the second vacuum chamber or in a further vacuum chamber downstream of the second vacuum chamber.

17. The method of claim 16, wherein the ions are mass analysed by a Time of Flight mass analyser.

18. The method of claim 1, comprising operating the spectrometer in a second mode in which the pressure in the first vacuum chamber and said voltage supply are controlled such that ions are fragmented at a substantially lower rate than in the first mode.

19. The method of claim 18, comprising mass analysing fragment ions in the first mode, mass analysing precursor ions in second mode, and correlating the fragment ions analysed in the first mode with their respective precursor ions analysed in the second mode.

20. A method of biotherapeutics characterisation or monitoring critical quality attributes comprising:

(i) providing a mass spectrometer comprising: a first vacuum chamber having an inlet aperture; a second vacuum chamber adjacent the first vacuum chamber; a differential pumping aperture separating the first and second vacuum chambers; an ion guide arranged in the first vacuum chamber for guiding ions from the inlet aperture to and through the differential pumping aperture, wherein the ion guide comprises a first portion configured to guide ions along a first axial path, a second portion configured to guide ions along a second different axial path, and a transition portion configured to urge ions from the first axial path onto the second axial path; and a voltage supply arranged and configured to apply voltages to electrodes in the spectrometer so as to accelerate ions through the first vacuum chamber;

(ii) transmitting ions through said inlet aperture into said ion guide;

(iii) guiding ions through said ion guide along said first axial path, through said transition portion and along said second axial path to said differential pumping aperture; and (iv) operating the spectrometer in the first mode in which the pressure in the first vacuum chamber and said voltage supply are controlled such that the ions are accelerated by the voltage supply so as to collide with gas in the first vacuum chamber and fragment to form fragment ions.

* * * * *